US005615876A

United States Patent [19]

Yergenson et al.

[11] Patent Number: 5,615,876

[45] Date of Patent: Apr. 1, 1997

[54] APPARATUS AND METHOD FOR SENSING ACCORDION JAMS IN A LASER PRINTER

[75] Inventors: Robin P. Yergenson, Eagle; Richard F. Beaufort, Boise, both of Id.

[73] Assignee: Hewlett-Packard Company, Palo Alto, Calif.

[21] Appl. No.: 569,817

[22] Filed: Dec. 8, 1995

[51] Int. Cl.[6] ..... B65H 7/02

[52] U.S. Cl. ..... 271/258.01; 271/259; 271/258.03; 271/258.04; 399/21

[58] Field of Search ..... 271/258.01, 259, 271/258.03, 258.04, 258.05, 261, 265.01–265.03; 355/316

[56] References Cited

U.S. PATENT DOCUMENTS

| | | | |
|---|---|---|---|
| 3,126,536 | 3/1964 | Schnell | 271/259 X |

FOREIGN PATENT DOCUMENTS

| | | | |
|---|---|---|---|
| 224934 | 12/1983 | Japan | 271/258.01 |
| 300948 | 12/1988 | Japan | 271/258.03 |
| 138047 | 5/1990 | Japan | 271/259 |
| 233434 | 9/1990 | Japan | 271/258.01 |
| 338064 | 11/1992 | Japan . | |
| 294505 | 11/1993 | Japan | 271/258.01 |
| 156808 | 6/1994 | Japan | 271/258.01 |

*Primary Examiner*—Boris Milef
*Attorney, Agent, or Firm*—Lane R. Simmons

[57] ABSTRACT

An apparatus for detecting a transfer medium (i.e., paper) accordion jam in a processing path of a laser printer comprises an accordion detection flag pivotally disposed near the processing path. In the event an accordion jam occurs to the transfer medium in the processing path, an accordioned portion of the transfer medium presses against the flag thereby forcing the flag to pivot for signaling the accordion jam. A preferred method for detecting an accordion jam comprises (a) storing a first time increment indicia indicative of a length of time elapsed for a leading and trailing edge of the transfer medium to pass a reference point in the processing path; (b) storing a second time indicia indicative of a point in time that the leading edge of the transfer medium forces the fuser sensor flag to activate the fuser sensor; (c) storing a third time increment indicia indicative of time elapsed since the second time indicia, measured at a point in time signaled, alternatively, by (i) the trailing edge of the transfer medium causing the fuser sensor flag to deactivate the fuser sensor, or (ii) in the event an accordion effect occurs to the transfer medium, an accordioned portion of the transfer medium forcing the accordion jam flag to deactivate the fuser sensor; and, (d) calculating a difference between the second and third time indicia, and in the event the difference is less than the first time indicia, signaling that an accordion jam has occurred.

9 Claims, 6 Drawing Sheets

APPARATUS AND METHOD FOR SENSING ACCORDION JAMS IN A LASER PRINTER

FIELD OF THE INVENTION

This invention relates in general to image transfer technology and, more specifically, to monitoring paper movement in a laser printer.

BACKGROUND OF THE INVENTION

Laser printers typically operate by using a D-roller to "grab" a sheet of paper (or other transfer medium) from a paper tray, and to send the paper on its way through a processing path within the printer. After initiating the process, a leading edge sensor detects the leading edge of the paper to allow for monitoring of the printing process. As timing is essential in electrophotographic (EP) processing, it is important to know where the paper is throughout the process and when it should be at specified stations. The leading edge sensor and other sensors in the system provide a means for monitoring the process.

Within the printer, a laser beam is scanned across an electrically charged photoconductor surface, such as a drum or belt, to form a latent image on the surface. A difference in electrostatic charge density is created between the areas on the surface exposed and unexposed to the laser beam. A visible image is developed by toners which are selectively attracted to the photoconductor surface, either exposed or unexposed to light, depending on the relative electrostatic charges of the photoconductor surface, development electrode, and the toner. The photoconductor may be either positively or negatively charged, and the toner similarly may contain negatively or positively charged particles. For receiving the image to be printed, the paper is given an electrostatic charge and passed close to a photoconductor surface. As the paper passes close to the photoconductor surface, it pulls the toner from the photoconductor surface onto the paper still in the pattern of the image developed from the photoconductor surface.

After receiving the image, the paper is passed through a fuser nip. The fuser nip is the contacting area between a heating element and a pressure roller. The fusing process permanently adheres the image to the paper.

After being fused, the paper continues its path through further output driver rollers to exit the printer. The paper may, optionally, exit through face up output rollers or through further face down output rollers to an output tray.

Since the fusing process uses high heat and pressure to adhere the image, the paper becomes supple as moisture escapes. As such, or for other reasons, the paper will at times adhere to and begin to wrap around the heating element as the paper exits the fuser nip, thus causing a paper wrapping jam. To detect a wrapping jam, a fuser sensor flag is often used after the fuser nip and before the output rollers, to sense whether the paper has wrapped or is continuing its projected path.

However, the fuser sensor flag does not detect paper accordion jams in a timely manner. An accordion jam will eventually be detected in the event the fuser sensor is not timely released, but by that time the accordioned paper can be wedged in so tight that it may require a service call to clear it.

Accordion jams occur when too much drag or compressive force is applied to a leading area of the paper. This drag or force typically initiates, for example, at the output tray by a user interfering with the exiting process, or by too much paper being stacked in the output tray causing a flow block, or by any one of a number of other factors. Since the fuser nip continues to push/process the paper in a forward motion, and the paper is supple from fusing, when too much drag is applied to the leading edge area, the excessive drag or force causes a force wave to propel through the paper from the fuser nip toward the leading edge. As such, the wave causes the paper to fold in an accordion effect near the fuser nip, thereby creating an accordion jam.

Accordion jams are not detectable by a conventional fuser sensor flag in a timely manner because the paper remains in contact with the fuser sensor flag during processing, whether an accordion jam occurs or not. An accordion jam is especially undesirable because it can be difficult to clear. The accordioned portion of the paper is typically inaccessible near the fuser within the printer. However, if an according jam can be detected early on, error processing of the printing system can be improved to avoid harsh jams.

Accordingly, objects of the present invention are to provide an improved system and method for sensing according jams in a laser printer.

SUMMARY OF THE INVENTION

According to principles of the present invention in a preferred embodiment, an apparatus for sensing a transfer medium (i.e., paper) accordion jam in a processing path of a laser printer comprises an accordion detection flag pivotably disposed near the processing path, whereby in the event an accordion jam occurs, an accordioned portion of the transfer medium presses against the flag thereby forcing the flag to move for signaling the accordion jam.

In a preferred embodiment, the flag includes a piece having an open hook shape disposed near the processing path such that an edge of the transfer medium passes through the open hook shape in the processing path. A signal means is disposed near the other end of the flag. In the event an accordion effect occurs to the transfer medium, the accordioned portion of the transfer medium presses against at least a portion of the open hook shape, thereby forcing the flag to pivot and activate the signal means for signaling the accordion jam.

According to further principles in a preferred embodiment, the signal means is a fuser sensor. The fuser sensor detects movement of a conventional fuser sensor flag and also the present invention accordion detection flag.

A preferred method for detecting an accordion jam comprises (a) storing a first time increment indicia indicative of a length of time elapsed for a leading and trailing edge of the transfer medium to pass a reference point in the processing path; (b) storing a second time indicia indicative of a point in time that the leading edge of the transfer medium forces the fuser sensor flag to activate the fuser sensor; (c) storing a third time increment indicia indicative of time elapsed since the second time indicia, measured at a point in time signaled, alternatively, by (i) the trailing edge of the transfer medium causing the fuser sensor flag to deactivate the fuser sensor, or (ii) in the event an accordion effect occurs to the transfer medium, an accordioned portion of the transfer medium forcing the accordion jam flag to deactivate the fuser sensor; and, (d) determining whether the third time indicia is less than the first time indicia, and in the event the third time indicia is less than the first time indicia signaling that an accordion jam has occurred.

Other objects, advantages, and capabilities of the present invention will become more apparent as the description proceeds.

DETAILED DESCRIPTION OF THE INVENTION

Figure 1:
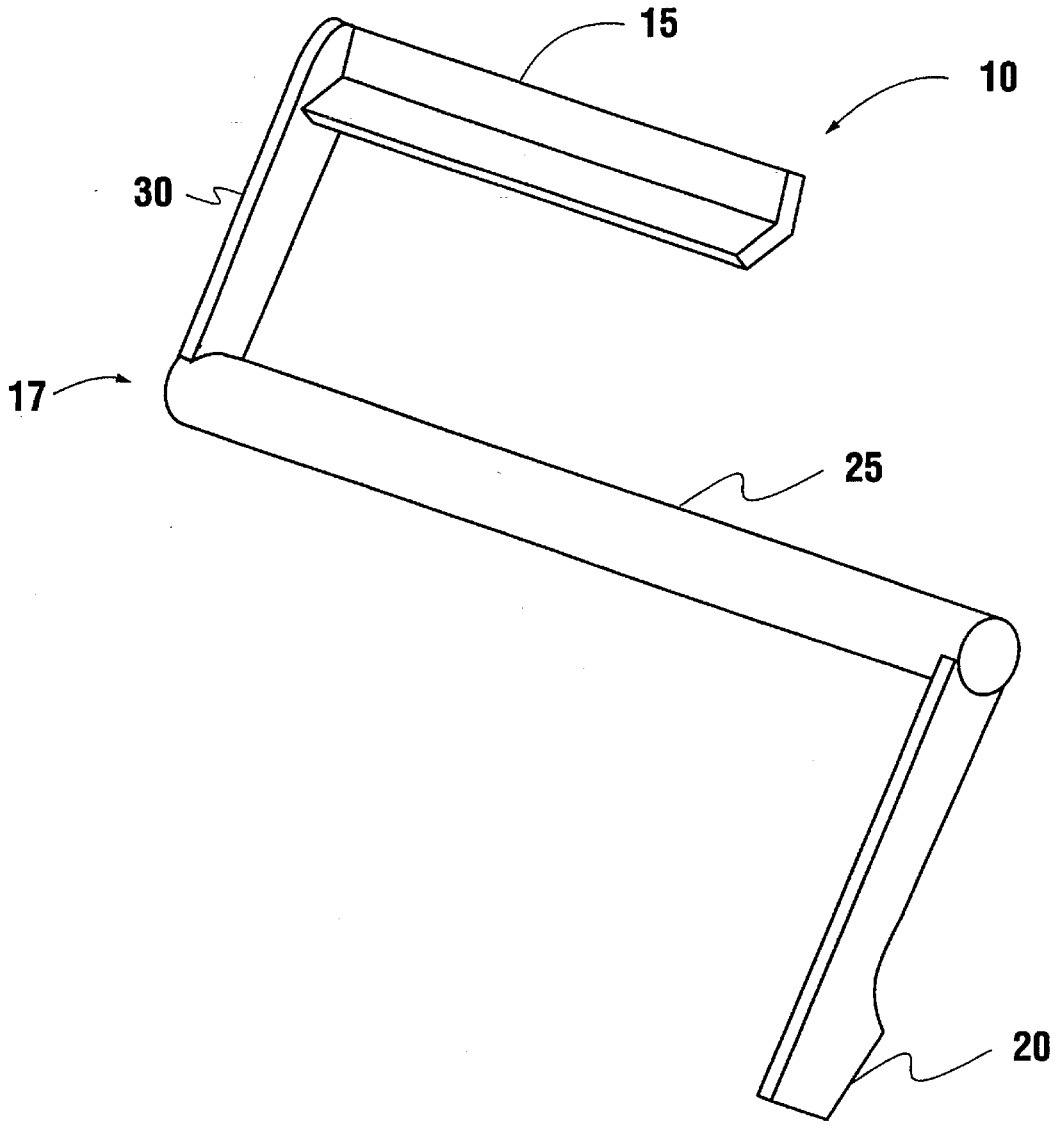
FIG. 1 is a perspective view of a preferred embodiment of the present invention flag arm for detecting accordion jams in a laser printer.

FIG. 1 shows a preferred embodiment of the present invention flag arm 10 for detecting accordion jams in an image transfer device. Although the invention is described in relation to laser printer technology, it is obvious that the invention is equally applicable to other image transfer devices known to those of ordinary skill in the art. Furthermore, although the invention is particularly applicable to detecting accordion effects (jams) of paper in a laser printer, and this disclosure generally references "paper" as the transfer medium, it is obvious that other transfer mediums are also equally applicable.

Flag arm 10 comprises first end 15 and second end 20. First end 15 forms a first portion of an open hook shaped piece shown generally at 17. Shaft 25 forms a second portion of open hook shaped piece 17, and end portion 30 joins first and second portions 15 and 25 to form the complete open hook shaped piece. Shaft 25 is rigidly attached to second end 20. Second end 20 is the actual "flag" portion of flag arm 10 and interfaces with a sensor (not shown) for signaling an accordion jam.

During normal printing/processing operations of a laser printer wherein the present invention is embodied, flag arm 10 is pivotally disposed near a transfer medium processing path in the laser printer. Specifically, flag arm 10 is disposed near the processing path immediately after the fusing nip and before any fuser sensor flag embodied in the printer. Flag arm 10 is disposed in the processing path such that any paper being processed (not shown) passes through the open hook shape 17 formed by first end (portion) 15, second portion 25, and end portion 30. First and second portions 15 and 25 are each disposed at opposite faces of the paper without touching the paper during normal processing in the processing path, and end portion 30 joins the first and second portions around an edge of the paper.

Figure 2:
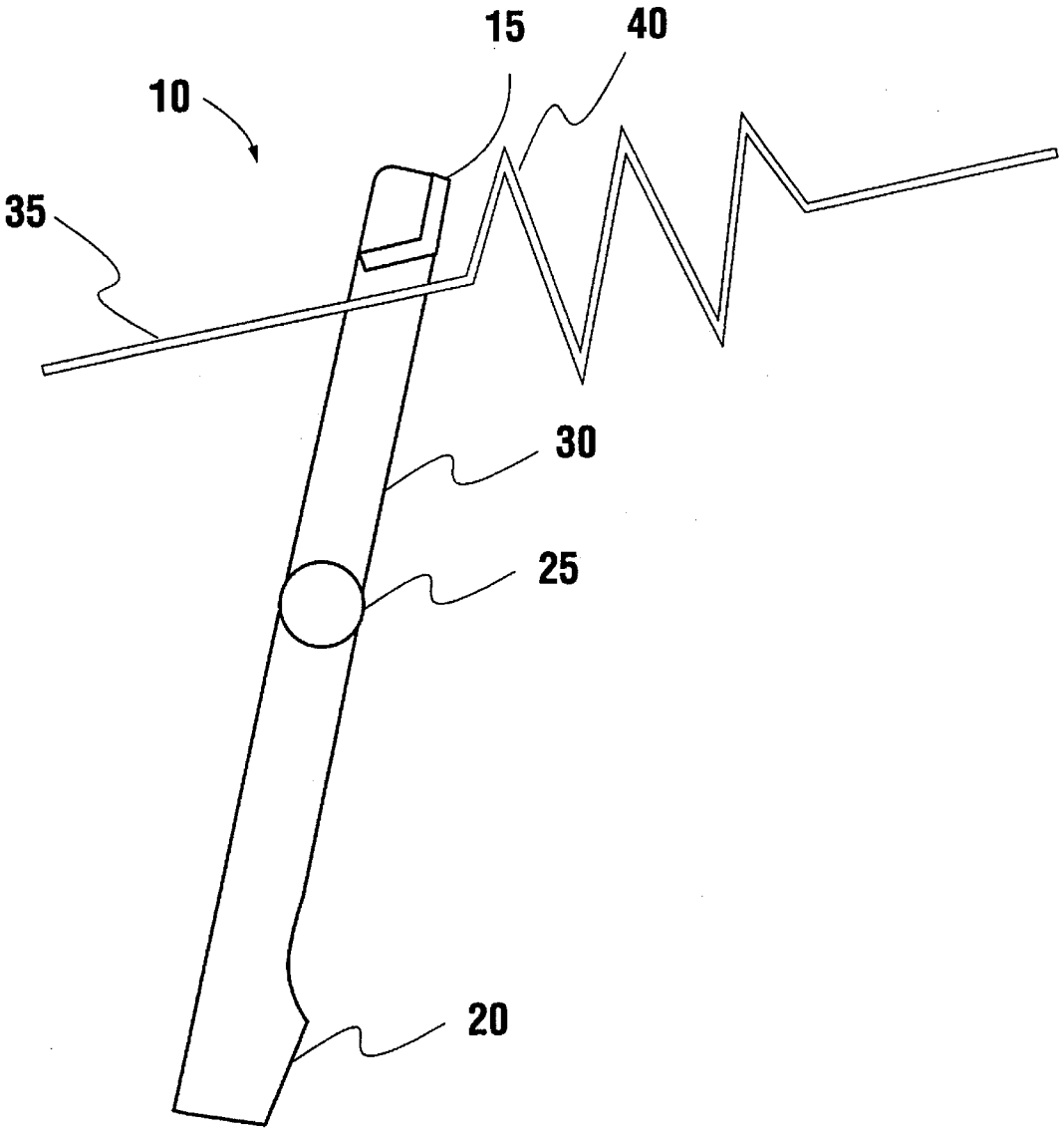
FIG. 2 is a right elevation view of the invention of FIG. 1 in use with an accordioned paper.

FIG. 2 depicts a right elevation view of flag arm 10 in conjunction with paper 35 having an accordioned portion 40. Flag arm 10 is pivotally disposed in the laser printer by means of second portion (shaft) 25. Shaft 25 is rigidly attached to second end 20 which swings to intercept a fuser sensor (not shown) in the printer upon rotation of shaft 25. When an accordion effect occurs to paper 35, the accordioned portion 40 contacts first end 15 and forces it to move in an arc pattern relative to pivotally attached shaft 25. This movement causes second end 20 to swing and signal the accordion effect by intercepting the fuser sensor.

Figure 3:
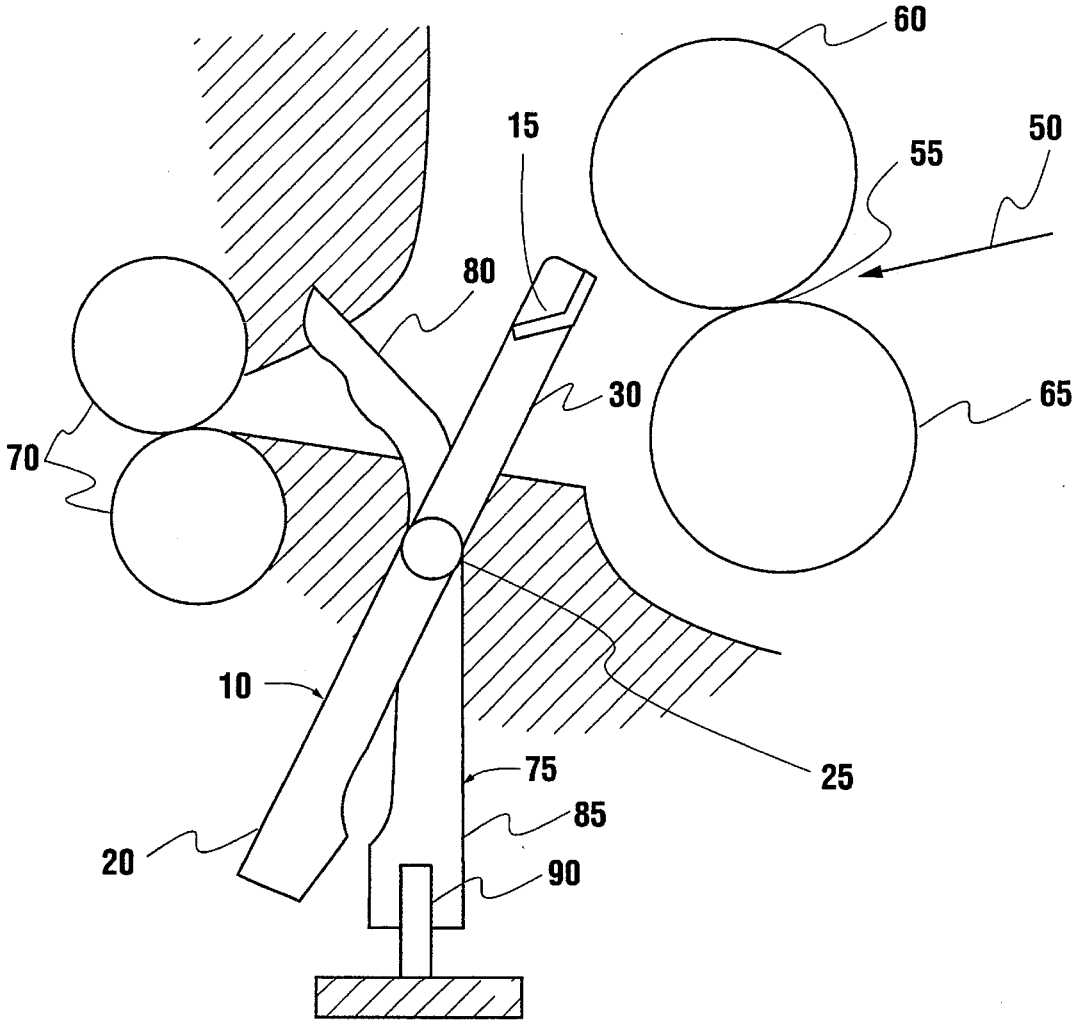
FIG. 3 is a right elevation view of the present invention disposed in a laser printer.

FIG. 3 is a right elevation view of flag arm 10 disposed in a laser printer. Directional arrow 50 shows the processing path for any paper passing through the printer. As the paper comes to fuser nip 55, which is comprised of the contacting area between heating element 60 and pressure roller 65, the fusing process permanently adheres an image to the paper. After being fused, the paper is directed toward output driver rollers 70 to exit the printer.

Fuser sensor flag 75 is a conventional flag well known in the art, and includes upper portion 80 and lower portion 85. In this example, fuser sensor flag 75 is pivotally disposed on shaft 25 of accordion flag arm 10. Obviously, fuser sensor flag 75 and flag arm 10 need not pivot at the same point, but a preferred method of the present invention provides for such in order to simplify components and reduce expense.

When a paper continues its processing path toward output rollers 70, the paper presses against fuser sensor flag 75 at upper portion 80 thereby causing lower portion 85 to swing away from fuser sensor 90. Fuser sensor 90 is a conventional light beam sensor as is well known in the art for sensing movement of fuser sensor flag 75. Under conventional schemes, if fuser sensor flag is not moved out of detection range of fuser sensor 90 within a predetermined amount of time, the printer will recognize that the paper may have incorrectly wrapped around heating element 60 and, accordingly, the printer will issue a wrapping jam error signal. On the other hand, if fuser sensor flag 75 is moved by properly processed paper within the appropriate time frame, it will stay moved from fuser sensor 90 until the trailing edge of the paper passes and allows the flag to swing back into its default position (as shown).

Although fuser sensor flag 75 can detect wrapping jams in connection with fuser sensor 90, the flag does not detect accordion jams in a timely manner (as previously discussed). An accordion jam may occur if too much drag or compressive force is applied to a leading area of the paper in its processing path. Since fuser nip 55 continues to push/process the paper in a forward motion, and the paper is supple from fusing, the excessive drag or force causes a wave to propel through the paper from the fuser nip toward the leading edge. As such, the wave causes the paper to fold in an accordion effect near the fuser nip, thereby creating an accordion jam (see FIG. 2).

When an accordion jam occurs, the present invention flag arm 10 detects the accordion effect and causes an accordion jam error signal to issue. Specifically, when the paper is being processed, fuser sensor flag 75 is pivoted away from sensor 90, and sensor 90 is activated (or it may be referred to as deactivated, depending on a reference perspective). The printer firmware knows that sensor 90 should only be blocked again (deactivated) when flag 75 swings back into its default position shown (after the paper has passed by and allowed the flag to swing back). However, if an accordion jam occurs, the accordioned portion of the paper presses against first end 15 of accordion flag arm 10, thereby causing second end 20 to swing into detection range of sensor 90 to deactivate the sensor. The firmware then calculates how much time has elapsed since fuser sensor flag 85 was moved away from sensor 90. In this case, the elapsed time is less than the predetermined appropriate time (i.e., the normal time for a paper to pass by fuser sensor flag 85), and the firmware recognizes that an accordion jam has occurred.

Figure 4:
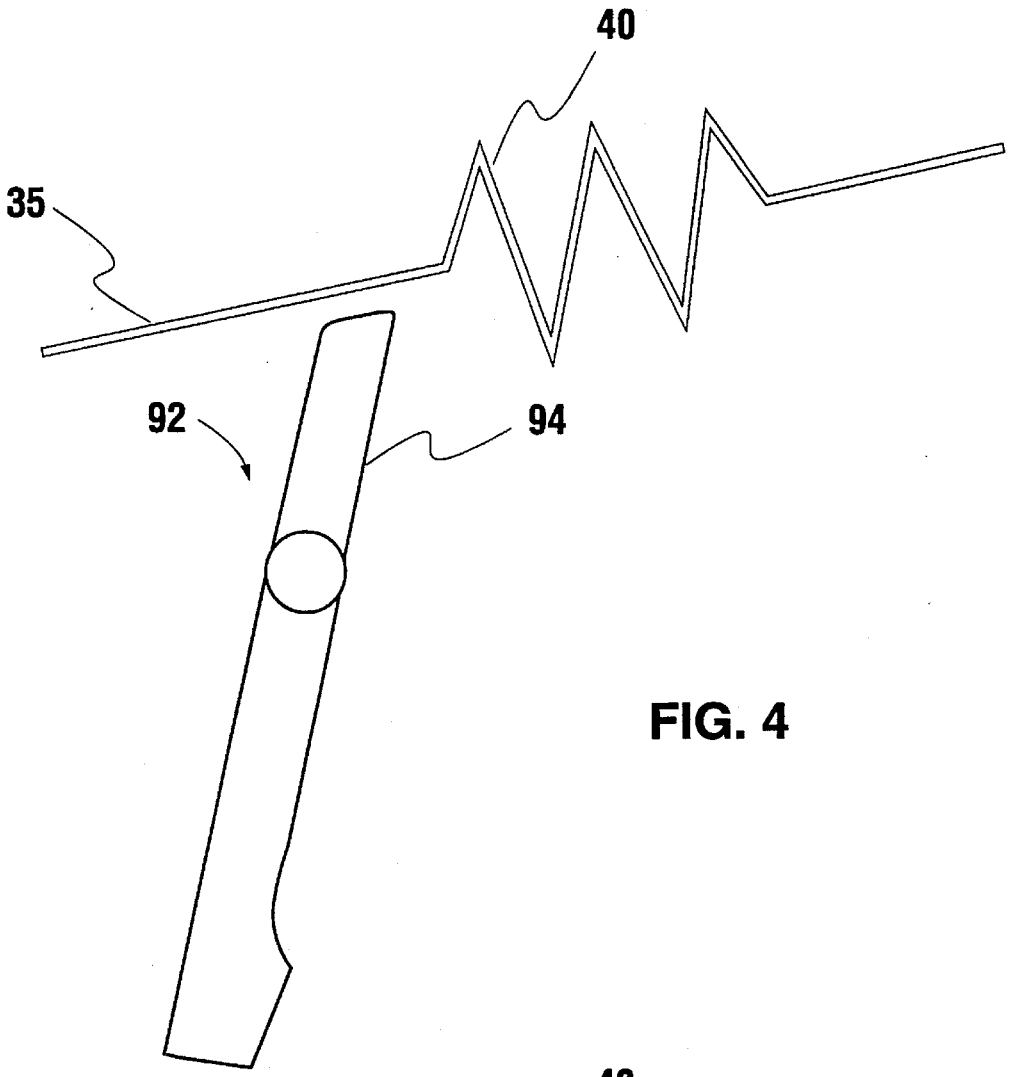
FIG. 4 is an elevation view of an alternate embodiment flag arm of the present invention for detecting accordion jams.
Figure 5:
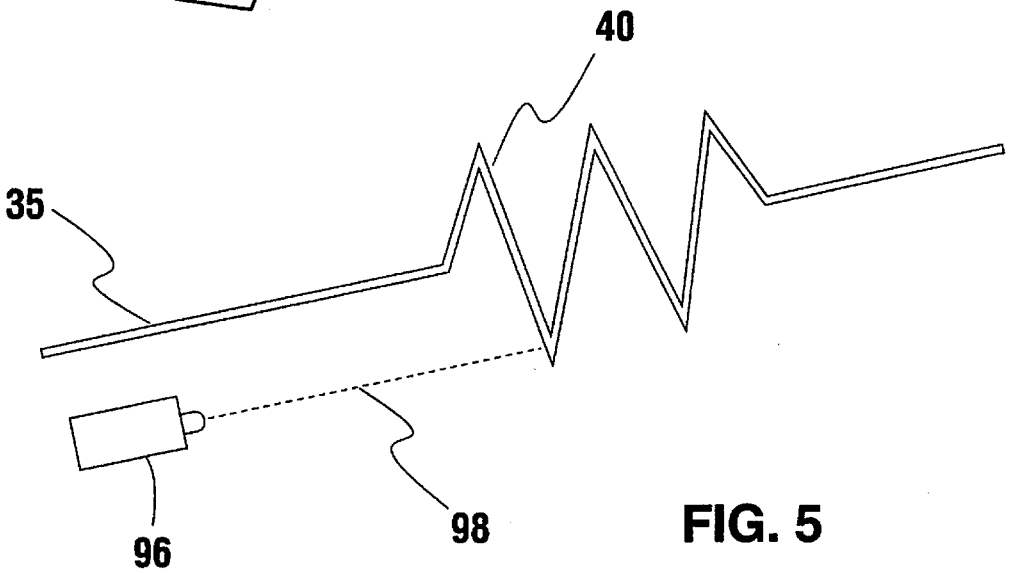
FIG. 5 is an elevation view of an alternate embodiment of the present invention wherein a light beam sensor is used for detecting accordion jams.

Although a preferred embodiment of the present invention is depicted in FIGS. 1–3 for simplifying manufacturing aspects and reducing costs, obviously, multiple variations may be implemented for accomplishing the general purpose of the present invention (i.e., detecting an accordion jam). For example, FIG. 4 is an elevation view showing an alternate embodiment wherein accordion flag 92 is an arm having upper portion 94 that projects to a position near accordioned portion 40 of paper 35. In this case, upper portion 94 projects near the paper without hooking around to the top of the paper for sensing an accordion effect. As another example, FIG. 5 depicts an alternate embodiment wherein a conventional light beam sensor 96 is placed such that the light beam 98 is interrupted by accordioned portion 40 of paper 35. As a further example, instead of employing existing fuser sensor 90 (FIG. 3), a separate sensor may be utilized for detecting movement of accordion jam flag 10.

Although various implementation means are possible, it is specifically important to have (a) an accordion sensing means of some sort (i.e., arm, light sensor, etc.) disposed within the image transfer device for sensing an accordioned portion of the transfer medium in the event an accordion effect occurs to the transfer medium in the processing path; and, (b) a signal means responsive to the accordion sensing means for signaling the occurrence of the accordion effect sensed. For example, in a preferred embodiment, the accordion sensing means is hook shaped piece 17 that contacts the accordioned portion of paper 40, and the signal means is sensor 90. Alternatively, however, the accordion sensing means and signal means could be the same apparatus. For example, if a light beam were used to sense the accordioned portion, its associated circuitry could also be used to signal the jam.

Figure 6:
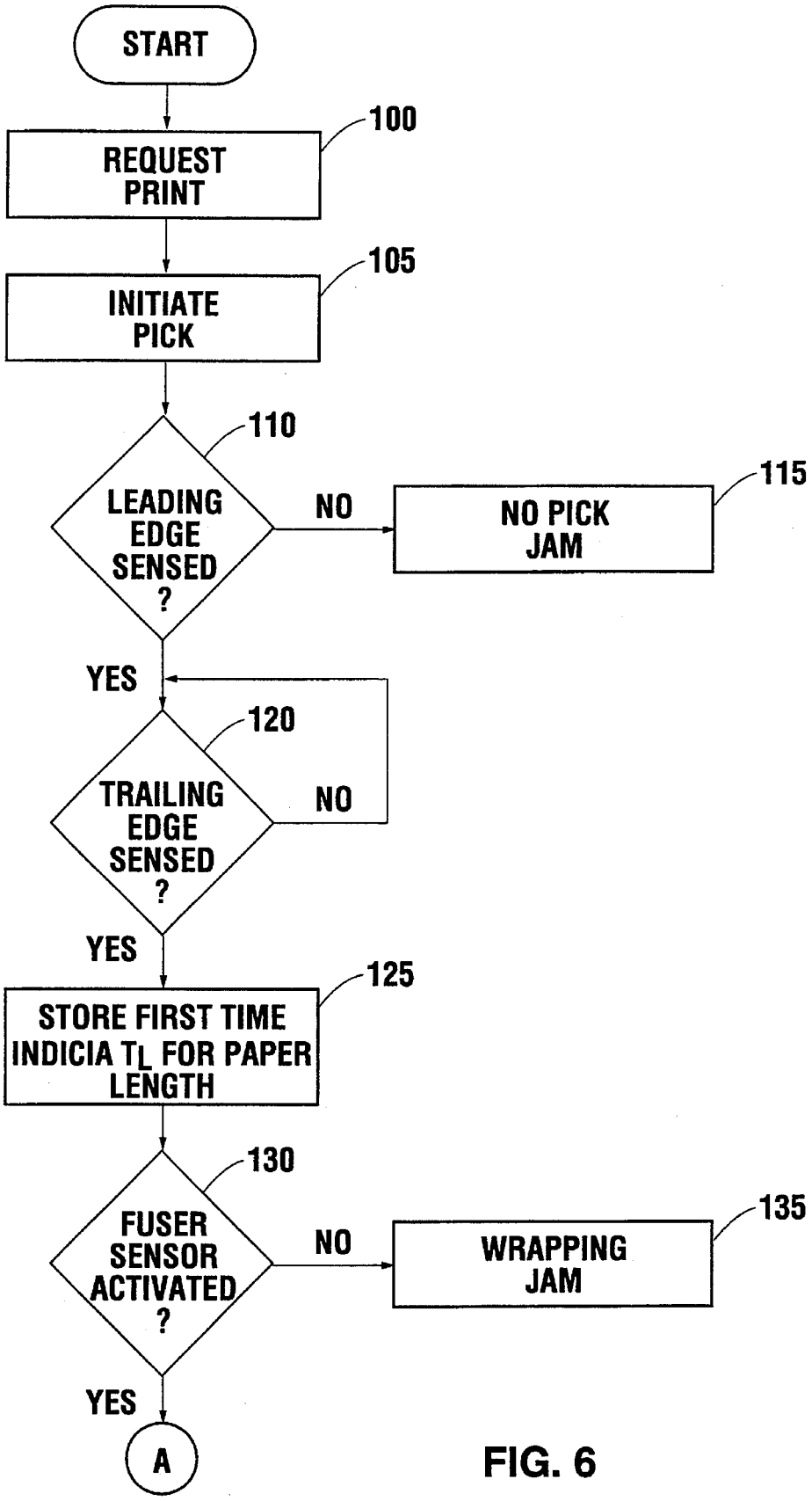
FIGS. 6 and 7 are a flow chart depicting a preferred method of the present invention for detecting accordion jams.
Figure 7:
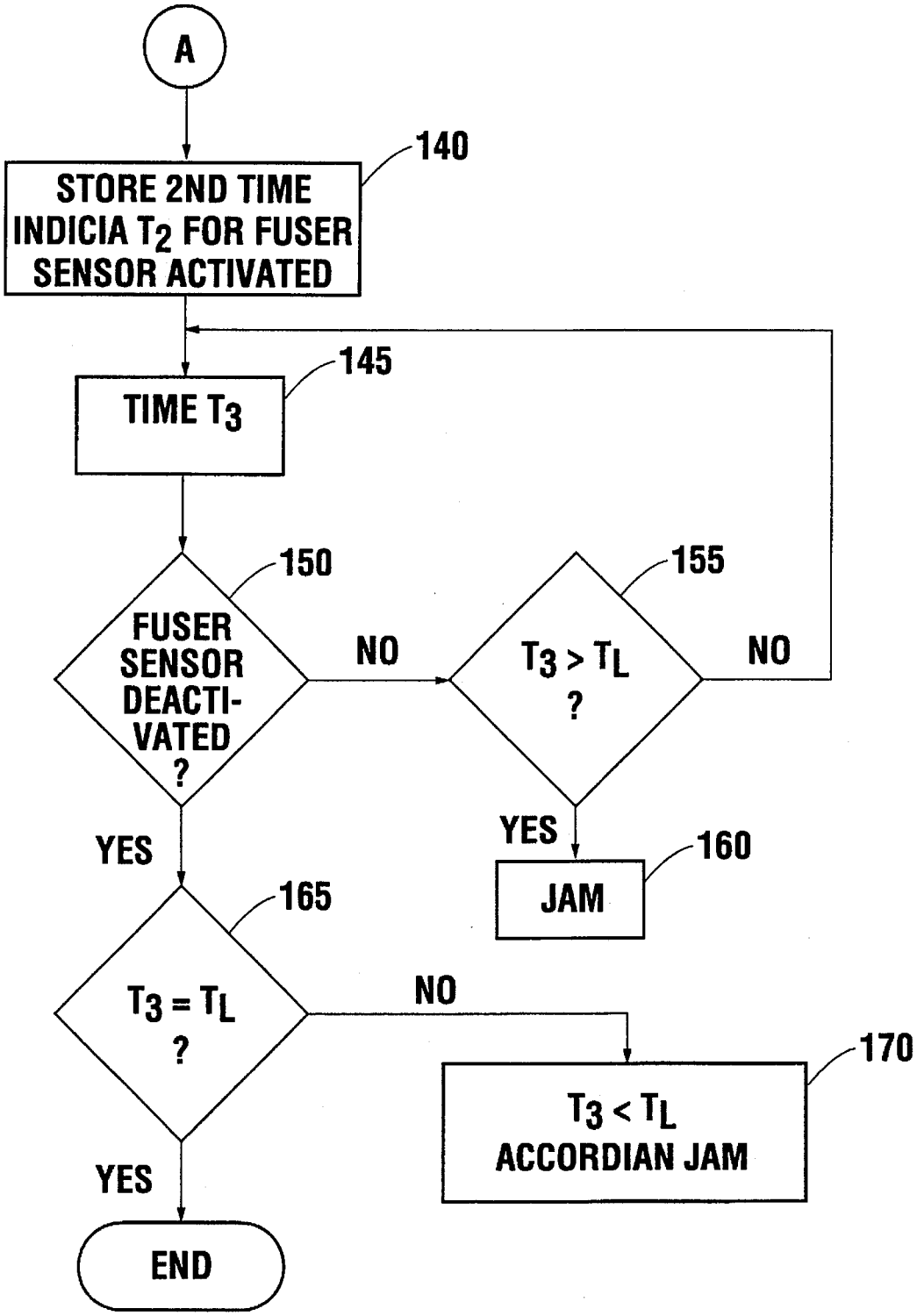

Referring now to FIGS. 6 and 7, a flow chart depicts a preferred method of the present invention for detecting accordion effects. This preferred method takes advantage of existing printer system architectures as much as possible to keep manufacturing and implementation costs to a minimum. Although not all details are shown and described relative to conventional laser printer processing, sufficient details are shown and described such that the method of the present invention can be easily understood in relation to conventional processing by those of ordinary skill in the art.

Upon receipt of a print request 100, a pick is initiated 105 by the printer for a sheet of paper (so long as paper is sensed as being available). The paper then starts down the processing path and the leading edge of the paper is sensed 110. If after a predetermined amount of time the leading edge is not sensed, a no-pick jam/error is detected 115. On the other hand, if the leading edge is sensed, as expected, the paper continues its processing path and the trailing edge of the paper is sensed 120. Then, a first time increment indicia $T_L$ is stored 125, indicative of the length of time elapsed for the leading and trailing edges of the paper to pass a reference point in the processing path.

Next, if the fuser sensor is not activated after a predetermined amount of time 130, it is apparent that a wrapping jam may have occurred 135. However, if the leading edge of the paper has continued its course past the fuser nip and appropriately activated the fuser sensor, then a second time indicia $T_2$ is stored 140, indicative of the point in time that the leading edge of the paper forces the fuser sensor flag to activate the fuser sensor.

As the paper continues down the processing path, the system maintains a lapse time (increment) $T_3$, 145, indicative of time elapsed since time $T_2$. Furthermore, the system constantly checks to see if the fuser sensor has been deactivated 150. If the fuser sensor has not been deactivated, and time $T_3$ is determined to be greater than $T_L$, 155, then some sort of paper jam has occurred 160.

In contrast, if the fuser sensor has been deactivated as expected, and time $T_3$ is approximately equal to $T_L$, 165, then processing has occurred without problem and the paper proceeds down the processing path to exit the printer. In this case, as the trailing edge of the paper passed the fuser sensor flag, the flag was allowed to return to its default position, thus deactivating the fuser sensor in a timely manner.

However, if the fuser sensor has been deactivated prematurely 170 (i.e., if time $T_3$ is less than $T_L$), then an error has occurred. Namely, the accordion jam flag has deactivated the fuser sensor in response to an accordion jam. Appropriate error handling can then occur to halt processing, correct the jam, notify the user, or the like.

In summary, what has been described above are the preferred embodiments for a system and method for detecting accordion jams in a laser printer. It will be obvious that the present invention is easily implemented utilizing any of a variety of hardware and software existing in the art. Furthermore, while the present invention has been described by reference to specific embodiments, it will be obvious that other alternative embodiments and methods of implementation or modification may be employed without departing from the true spirit and scope of the invention.

What is claimed is:

1. An apparatus for detecting an accordion effect on a transfer medium in a processing path of an image transfer device, the apparatus comprising:

(a) a pivotally movable arm for contacting the accordioned portion of the transfer medium in the event an accordion effect occurs to the transfer medium in the processing path;

(b) a pivotally movable fuser sensor flag for contacting the transfer medium prior to the transfer medium exiting the image transfer device; and (c) a fuser sensor for signaling movement of the arm and the fuser sensor flag.

2. The apparatus of claim 1 wherein the arm includes first and second ends, the first end disposed near the processing path for contacting the accordioned portion of the transfer medium, and the second end for communicating with the fuser sensor for signaling movement of the arm in response to the accordioned portion of the transfer medium pressing against the first end.

3. The apparatus of claim 2 wherein the first end of the arm includes an open hook shaped piece comprising a first and second portion, each portion disposed at opposite faces of the transfer medium without touching the transfer medium during normal processing in the processing path, and an end portion joining the first and second portions around an edge of the transfer medium.

4. The apparatus of claim 3 wherein the second portion is pivotally attached near the processing path at a pivot point and rigidly attached to the second end of the arm, and the accordioned portion of the transfer medium presses against the first portion, thereby causing the first portion to move in an arc pattern relative to the pivot point, and the second end of the arm to move for signaling the accordion effect.

5. A system for sensing an accordion effect on a transfer medium in a processing path of an image transfer device, the system comprising:

(a) a pivotally movable flag arm for contacting an accordioned portion of the transfer medium in the event an accordion effect occurs to the transfer medium in the processing path, the flag arm includes an open hook shaped piece disposed near the processing path such that an edge of the transfer medium passes through the open hook shaped piece in the processing path, the hook shaped piece comprises a first and second portion, each portion disposed at opposite faces of the transfer medium without touching the transfer medium during normal processing in the processing path, and an end portion joining the first and second portions around an edge of the transfer medium; and (b) signal means disposable in the image transfer device for signaling pivotal movement of the flag arm in the event an accordion effect occurs to the transfer medium.

6. The system of claim 5 wherein the second portion is pivotally attached near the processing path at a pivot point and rigidly attached to the flag arm, and the accordioned portion of the transfer medium presses against the first portion, thereby causing the first portion to move in an arc pattern relative to the pivot point, and the second end of the flag arm to move for signaling the accordion effect.

7. The system of claim 5 further comprising a fuser sensor flag, and wherein the signal means is a fuser sensor for, alternatively, (i) sensing and signaling movement of the fuser sensor flag as indicia of a transfer medium wrapping jam, or (ii) sensing and signaling the flag arm movement as indicia of an accordion effect.

8. The system of claim 7 further including:

(a) means for storing a first time increment indicia indicative of a length of time elapsed for a leading and trailing edge of the transfer medium to pass a reference point in the processing path;

(b) means for storing a second time indicia indicative of a point in time that the leading edge of the transfer medium forces the fuser sensor flag to activate the fuser sensor;

(c) means for storing a third time increment indicia indicative of time elapsed since the second time indicia, measured at a point in time signaled, alternatively, by (i) the trailing edge of the transfer medium causing the fuser sensor flag to deactivate the fuser sensor, or (ii) in the event an accordion effect occurs to the transfer medium, an accordioned portion of the transfer medium forcing the flag arm to deactivate the fuser sensor; and, (d) means for determining whether the third time indicia is less than the first time indicia, and signaling that an accordion jam has occurred when said third time indicia is less than the first time indicia.

9. A method of detecting an accordion effect on a transfer medium in a processing path of an image transfer device, the image transfer device includes a fuser sensor flag, an accordion detection flag, and a fuser sensor, each said flag being operatively associated with the fuser sensor, the method comprising:

(a) storing a first time increment indicia indicative of a length of time elapsed for a leading and trailing edge of the transfer medium to pass a reference point in the processing path;

(b) storing a second time indicia indicative of a point in time that the leading edge of the transfer medium forces the fuser sensor flag to activate the fuser sensor;

(c) storing a third time increment indicia indicative of time elapsed since the second time indicia, measured at a point in time signaled, alternatively, by (i) the trailing edge of the transfer medium causing the fuser sensor flag to deactivate the fuser sensor, or (ii) in the event an accordion effect occurs to the transfer medium, an accordioned portion of the transfer medium forcing the accordion detection flag to deactivate the fuser sensor;

(d) signaling that an accordion jam has occurred in the event the third time indicia is less than the first time indicia.

* * * * *